US006241348B1

(12) United States Patent
Haigo

(10) Patent No.: US 6,241,348 B1
(45) Date of Patent: Jun. 5, 2001

(54) PACKAGE FOR INK CARTRIDGE AND METHOD FOR MANUFACTURING THE SAME

(75) Inventor: Hideaki Haigo, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/130,467

(22) Filed: Aug. 7, 1998

(30) Foreign Application Priority Data

Aug. 11, 1997 (JP) ..... 9-216205

(51) Int. Cl.[7] ..... B41J 2/175
(52) U.S. Cl. ..... 347/86
(58) Field of Search ..... 347/86, 108, 85; 206/205, 469, 461, 701, 497

(56) References Cited

U.S. PATENT DOCUMENTS 5,244,087 * 9/1993 Hikake et al. ..... 347/87
5,262,802 11/1993 Karita et al. .
5,590,510 * 1/1997 Mochizuki et al. ..... 347/85
5,701,995 * 12/1997 Higuma et al. ..... 347/86
5,790,157 * 8/1998 Higuma et al. ..... 347/85

FOREIGN PATENT DOCUMENTS 5-162326 * 6/1993 (JP) .
9-70982 3/1997 (JP) .
10-58697 * 3/1998 (JP) ..... B41J/2/175

* cited by examiner

*Primary Examiner*—N. Le
*Assistant Examiner*—Judy Nguyen
(74) *Attorney, Agent, or Firm*—Oliff & Berridge, PLC

(57) ABSTRACT

An ink-cartridge package comprises a packaging bag. This packaging bag has a resin layer inside the bag, the resin layer being meltable and adherent to the ink cartridge. A portion of the packaging bag is stuck onto areas around the ink supply hole and the air hole on the ink cartridge surface by a heat sealing process in a peelable manner, whereby the ink supply hole and the air hole are sealed. The opening of the packaging bag is sealed, and a tear notch is formed in this heat-sealed edge at a position closer to the air hole than to the ink supply hole in order to allow the packaging bag to be opened from the air hole side. The packaging bag functions as both an enclosure of the ink cartridge and a sealing member for sealing the ink supply hole and the air hole of the ink cartridge, whereby the number of parts used in the package is reduced. In addition, this package can prevent the ink from scattering in an area surrounding the packaging bag when the ink cartridge is removed from the bag.

14 Claims, 5 Drawing Sheets

2

PACKAGE FOR INK CARTRIDGE AND METHOD FOR MANUFACTURING THE SAME

BACKGROUND OF THE INVENTION

1. Field of the Invention

This invention relates to a package for an ink cartridge used in, for example, ink-jet printers, and a method for manufacturing the package.

2. Description of the Related Art

An ink jet printer outputs data by ejecting ink droplets from nozzle holes of a recording head onto a recording medium (e.g., recording paper). An ink cartridge is installed in the printer in order to supply ink to the recording head. Such an ink cartridge is generally replaceable when the ink runs out.

A conventional ink cartridge is filled with a porous material which absorbs and stores ink in it. This ink cartridge has an ink supply hole, in which an ink inlet tube of the recording head is inserted in order to introduce the ink into the recording head. The ink cartridge also has an air hole, in addition to the ink supply hole, in order to keep the interior pressure of the ink cartridge at atmospheric pressure and to smoothly supply the ink from the porous material to the recording head via the ink supply hole.

When shipping the ink cartridges, the ink supply hole and the air hole of each ink cartridge are sealed by sealing tape for the purpose of preventing leakage or evaporation of ink and, then, each ink cartridge is packed in a packaging bag which can be easily opened by a user prior to actual use of the ink cartridge.

However, in this conventional method, both sealing tape and a package are separately used, which increases the number of packaging steps and elements. The amount of trash also increases, which is undesirable for environmental reasons. In addition, when the user replaces the ink cartridge with a new one, the package is opened first, and then, the sealing tape must be peeled off. Such double steps are troublesome to the user.

Furthermore, because the ink supply hole of the ink cartridge is sealed with sealing tape, a portion of ink absorbed in the porous material is likely to stick onto an inner surface (i.e., the adherent surface) of the sealing tape. In this case, when the user peels off the sealing tape, the ink droplets that are stuck to the sealing tape scatter around, and the user and the surroundings may be stained.

SUMMARY OF THE INVENTION

Therefore, it is an object of the invention to eliminate these drawbacks of the conventional art and provide a package for an ink cartridge which can directly seal the ink supply hole and the air hole upon packaging the ink cartridge. It is another object of the invention to provide a method of manufacturing such a package for an ink cartridge.

In order to achieve the object, one aspect of the invention provides an ink-cartridge package which includes a packaging bag for packaging an ink cartridge that contains ink. The ink cartridge has an ink supply hole and an air hole. A resin layer is formed inside the packaging bag, the resin layer being meltable and adherent to the ink cartridge. When packaging the ink cartridge, a portion of the packaging bag is adhered to the areas around the ink supply hole and the air hole on the ink cartridge surface in a peelable manner, whereby the ink supply hole and the air hole are sealed.

In this arrangement, the packaging bag for enclosing an ink cartridge functions as a sealing member for sealing the ink supply hole and the air hole because the resin layer formed inside the packaging bag sticks to the areas around the ink supply hole and the air hole on the ink cartridge surface. Thus, the ink supply hole and the air hole are sealed without separately using sealing tape. When the packaging bag is opened and the ink cartridge is taken out of the bag, the packaging bag is peeled off from the adhesive areas around the ink supply hole and the air hole. An extra step of peeling off sealing tape, which is required for a conventional package, can be eliminated.

The packaging bag further has a nonpermeable layer for preventing permeation of moisture and air through the packaging bag.

The interior of the ink cartridge enclosed by the packaging bag is insulated from the outside by this nonpermeable layer. Since the air and moisture are blocked, the condition of the ink contained in the ink cartridge can be maintained stably over a long period of time.

The ink supply hole and the air hole are formed at opposite ends of the ink cartridge, and the packaging bag has a width corresponding to the dimensions of the ink cartridge so that the packaging bag fits the ink cartridge.

By setting the width of the packaging bag so as to correspond to the dimensions of the ink cartridge, the ink cartridge fits right into the packaging bag and, at the same time, the ink supply hole and the air hole are appropriately sealed. Even during transportation of the ink cartridges, the position of the ink cartridge relative to the packaging bag does not change, which can prevent an undesirable force from being applied onto the adhered part between the ink cartridge and the packaging bag. In other words, a situation in which the sealing portion of the packaging bag peels off from the ink cartridge during transportation can be avoided.

The packaging bag is, for example, a sleeve-like bag, and its opening ends are sealed by heat sealing, thereby completely sealing the packaging bag in order to protect the ink cartridge from the external atmosphere.

The packaging bag has a tear cut for allowing the bag to be opened easily, while leaving the ink supply hole still sealed with a part of the bag which wraps around the side surface of the ink cartridge extending from the ink supply hole.

When the packaging bag is opened from the tear cut and cut off, a part of the packaging bag which sticks around the ink supply hole and wraps around the side surface of the ink cartridge extending from the ink supply hole still remains. Then, when the ink cartridge is taken out of the remaining part of the packaging bag, the adhesive part of the packaging bag is peeled off from the ink supply hole. In this arrangement, even if a small quantity of ink scatters from the ink supply hole, it is blocked by the packaging bag, and does not stain the surroundings.

As an alternative, the packaging bag has a tear cut formed in the edge of the bag at a position closer to the air hole rather than to the ink supply hole.

When taking the ink cartridge out of the packaging bag, the packaging bag is opened from the tear cut, and cut off from the air hole side. The ink supply hole is exposed to the air after the air hole is opened. This arrangement can prevent the air from mixing with the ink near the ink supply hole. In addition, similar to the previous example, when the ink cartridge is taken out of the remaining part of the packaging bag, the adhered part of the packaging bag is peeled off from the ink supply hole inside the bag, which can prevent ink from scattering in an area surrounding the packaging bag.

The tear cut is, for example, a notch formed at a position closer to the air hole than to the ink supply hole.

Again, the packaging bag is easily opened from the air hole side.

Another aspect of the invention provides a method for manufacturing an ink-cartridge package which includes a packaging bag for packaging an ink cartridge that contains ink. A resin layer is formed inside of the packaging bag, the resin layer being meltable and adherent to the ink cartridge. The ink cartridge has an ink supply hole and an air hole. This method includes the steps of inserting the ink cartridge in the packaging bag in a substantially vacuum atmosphere, and sticking a portion of the packaging bag onto the areas around the ink supply hole and the air hole on the ink cartridge surface in a peelable manner, thereby sealing the ink supply hole and the air hole.

In this method, after the ink cartridge is inserted into the packaging bag that has a thermally adherent resin layer, a portion of the packaging bag sticks to the areas around the ink supply hole and the air hole on the ink cartridge surface in a peelable manner. Thus, a part of the packaging bag is used as a sealing member, and the ink cartridge is easily packed in the package with the ink supply hole and the air hole sealed.

The packaging bag is, for example, a sleeve-like bag. In this case, the method further includes the step of, after sealing the ink supply hole and the air hole, sealing opening ends of the bag.

The ink cartridge is inserted into the sleeve-like packaging bag from either opening end. After the ink supply hole and the air hole are sealed with a portion of the packaging bag, the opening ends of the sleeve-like bag are sealed. The packaging bag functions both as an enclosure and a sealing member.

BRIEF DESCRIPTION OF THE DRAWINGS

A preferred embodiment of the invention will be described in detail with reference to the following figures wherein.

DETAILED DESCRIPTION OF THE PREFERRED EMBODIMENTS

A preferred embodiment of the invention will now be described with reference to the attached drawings.

Figure 1:
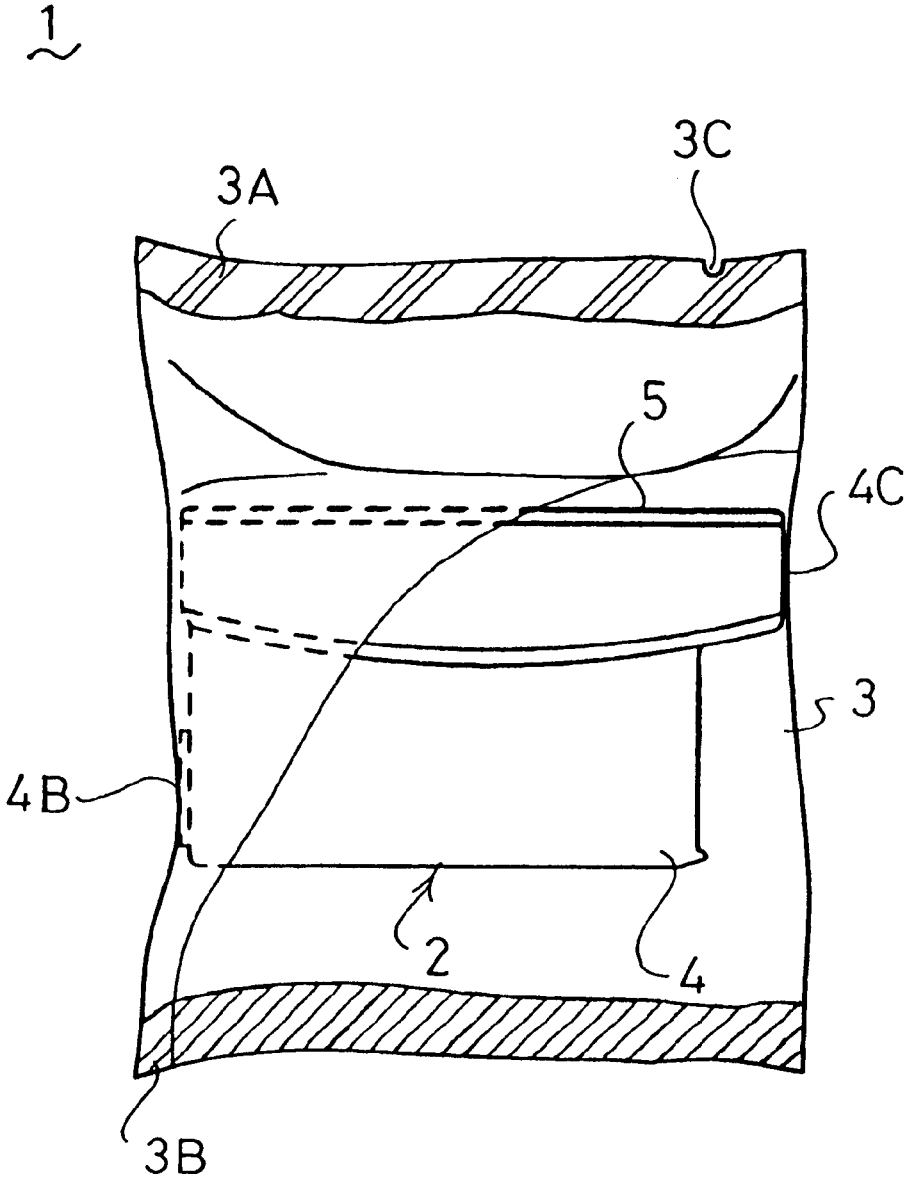
FIG. 1 is a partially cutaway front view of a packaging bag for an ink cartridge according to the invention.

FIG. 1 illustrates a package for an ink cartridge according to the invention. The package 1 comprises a packaging bag 3 for enclosing an ink cartridge 2. This ink cartridge 2 is used in an ink-jet printing apparatus which prints out data by ejecting ink droplets onto a recording medium.

The packaging bag 3 has a sleeve-like shape with a width corresponding to the dimensions of the ink cartridge enclosed in the packaging bag 3. Both end openings of the sleeve-like bag 3 are sealed by heat sealing, and are illustrated as the top sealed end 3A and the bottom sealed end 3B in FIG. 1. After the end openings are sealed, the packaging bag forms a sealed space, in which the ink cartridge 2 is stored.

Figure 2:
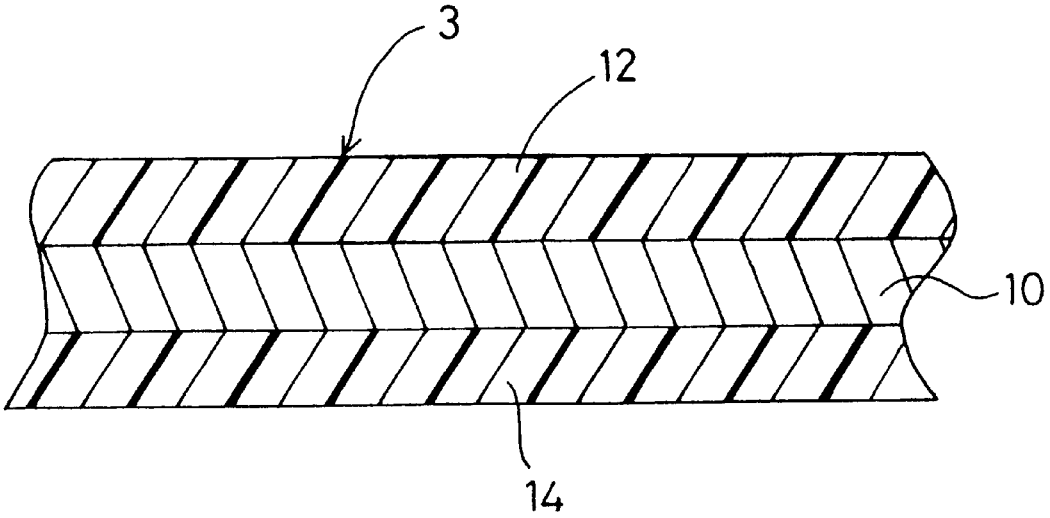
FIG. 2 is a cross-sectional view of the packaging bag.

As shown in FIG. 2, the packaging bag 3 has a nonpermeable layer 10 (e.g., an aluminum layer) for shutting out permeation of air and moisture so that the condition of the ink in the ink cartridge 2 is maintained stably over a long span of time without being affected by the external atmosphere. The nonpermeable layer 10 can be provided to a thickness of 7–10 $\mu$m. The outer surface of the nonpermeable layer 10 is covered by an outer resin layer 12 which is made of, for example, nylon or PET. The outer resin layer 12 absorbs externally applied impacts. The outer resin layer 12 can be provided to a thickness of 40–50 $\mu$m. On the other hand, an inner resin layer 14 is formed inside the nonpermeable layer 10. The inner resin layer 14 is made of, for example, polypropylene, polyethylene, or polyolefin, which are meltable and adherent to the ink cartridge 2 upon the application of heat.

The property of the inner resin layer 14 of the packaging bag 3 is similar to that of conventional sealing tape used to seal the ink supply hole and the air hole. Thus, the packaging bag 3 functions as both a package for enclosing the ink cartridge and a sealing member for sealing the ink supply hole and the air hole. Additionally, not only is the inner resin layer 14 strongly adherent to the ink cartridge 2, but it can also be removed without damaging the ink cartridge 2. For example, if the material of the ink cartridge 2 contains polypropylene as a major component, the inner resin layer of the packaging bag 3 is made of a polyolefin mixture (having a trade name CMPS009 and a thickness of 30 $\mu$m). Thus, the entire packaging bag 3 may have a total thickness of approximately 80 $\mu$m.

Figure 3:
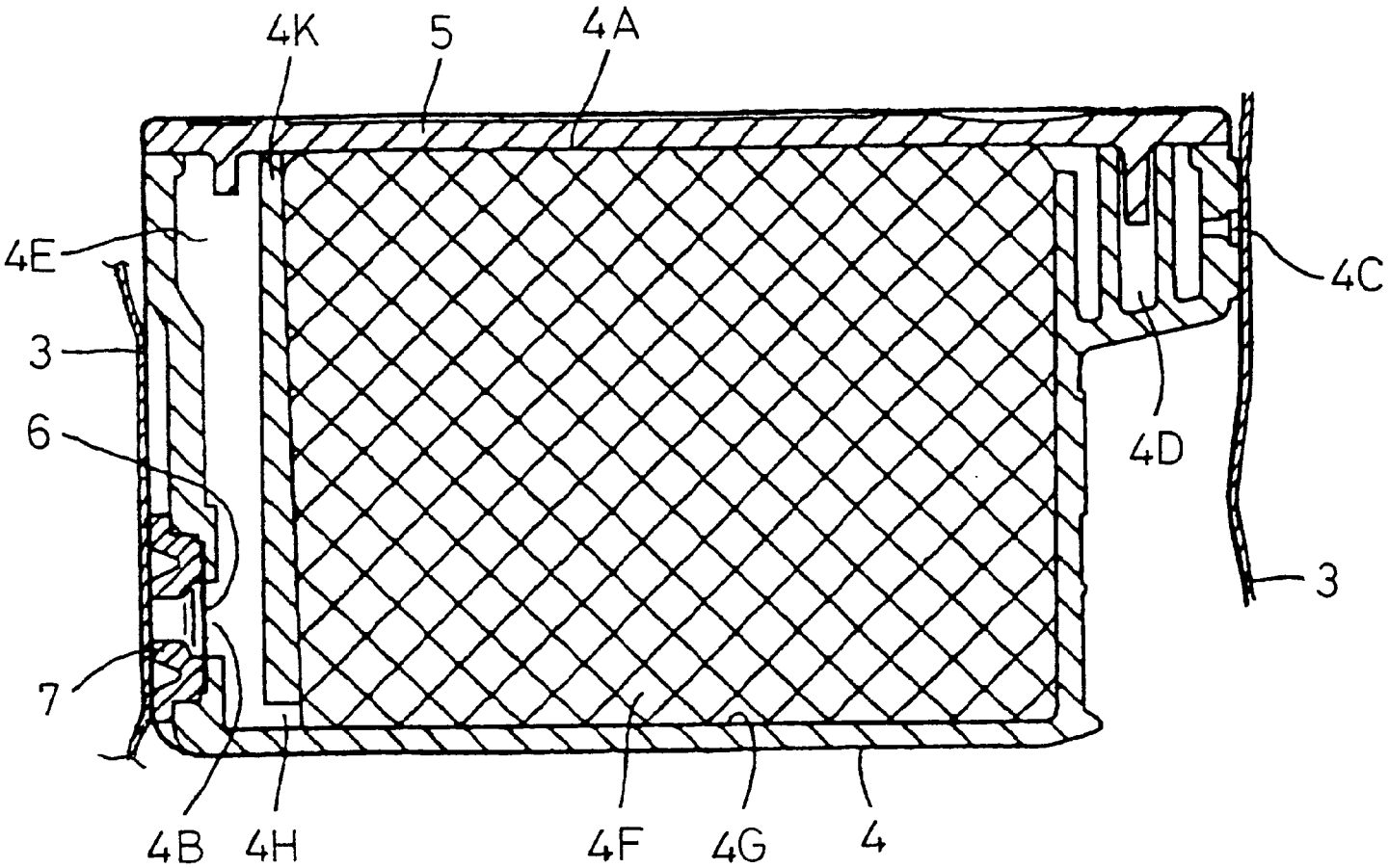
FIG. 3 is a cross-sectional view of the ink cartridge enclosed by the packaging bag, a part of the packaging bag being omitted.

As shown in FIG. 3, the ink cartridge 2 comprises a cartridge case 4 which has a top opening 4A. The top opening 4A is capped by a lid 5.

An ink supply hole 4B is formed in one end of a side wall of the cartridge case 4, through which the ink contained in the ink cartridge 2 is supplied to the printing head (not shown). An air hole 4C is formed in the other end of the side wall of the cartridge case 4 for the purpose of pressing for smooth ink supply. An air buffer 4D, which is a zigzag passage connecting the air hole 4A and the foam chamber 4G (which will be described below), is formed inside the air hole 4C in order to prevent the ink from evaporating through the air hole 4C.

The interior of the cartridge case 4 is partitioned by a partition 4K into two chambers, namely, an ink chamber 4E on the ink supply hole side, and a foam chamber 4G on the air hole side. The foam chamber 4G is filled with a porous material 4F which absorbs and stores ink. The porous material 4F can be made of polyurethane foam. The ink chamber 4E and the foam chamber 4G communicate with each other via a passage 4H formed at the bottom of the partition 4K. The porous material 4F is stuffed into the foam chamber 4G from the top opening 4A in a compressed state. Then, degassed ink is injected into the foam chamber 4G via the ink supply hole 4B by an ink injector (not shown).

A meshed filter 6 is provided at the ink supply hole 4B of the cartridge case 4 for the purpose of removing dust or undesirable particles before the ink is supplied to the printing head (not shown). An adapter 7 is also provided at the ink supply hole 4B in order to appropriately connect the ink supply hole 4B with the printing head (not shown).

After the ink cartridge 2 is filled with ink, a portion of the packaging bag 3 is thermally melted, and stuck to the area around the ink supply hole 4B and the air hole 4C on the outer surface of the cartridge case 4 in a peelable manner in order to prevent the ink from evaporating before the actual use. In this manner, the ink supply hole 4B and the air hole 4C are sealed with a portion of the packaging bag 3 for enclosing the ink cartridge 2.

As shown in FIG. 1, a notch (or tear cut) 3C is formed in the top heat-sealed end 3A of the packaging bag 3 at a position closer to the air hole 4C than to the ink supply hole 4B. This notch 3C facilitates opening the packaging bag 3 from the air hole side. The notch is formed so that the packaging bag 3 is torn from the top heat-sealed end 3A toward the bottom heat-sealed end 3B.

When taking the ink cartridge 2 out of the package 1, the user tears the packaging bag 3 from the notch 3C. When the side of the packaging bag 3 is cut off from the top heat-sealed end 3A to the bottom heat-sealed end 3B, the adherent part of the packaging bag 3 is peeled off from ink cartridge surface, and the air hole 4C is exposed to the atmosphere. At this time, the remaining portion of the packaging bag 3 still clings to the ink cartridge 2 via the adherent portion around the ink supply hole 4B. Since the notch 3C is formed near the air hole 4C, the remaining packaging bag 3 has an opening, from which a part of the ink cartridge and the air hole 4C are exposed, while the ink supply hole 4B and the side wall of the ink cartridge 2 extending from the ink supply hole 4B are still in the packaging bag 3.

Then, as the remaining packaging bag 3 is peeled off from the ink cartridge 2, the ink supply hole 4B is unsealed. At this time, even if a small quantity of ink scatters from the ink supply hole 4B, it does not stain the surroundings because the ink droplets are blocked within the remaining packaging bag 3.

Next, a method for manufacturing the ink cartridge package 1 will be described.

Figure 4:
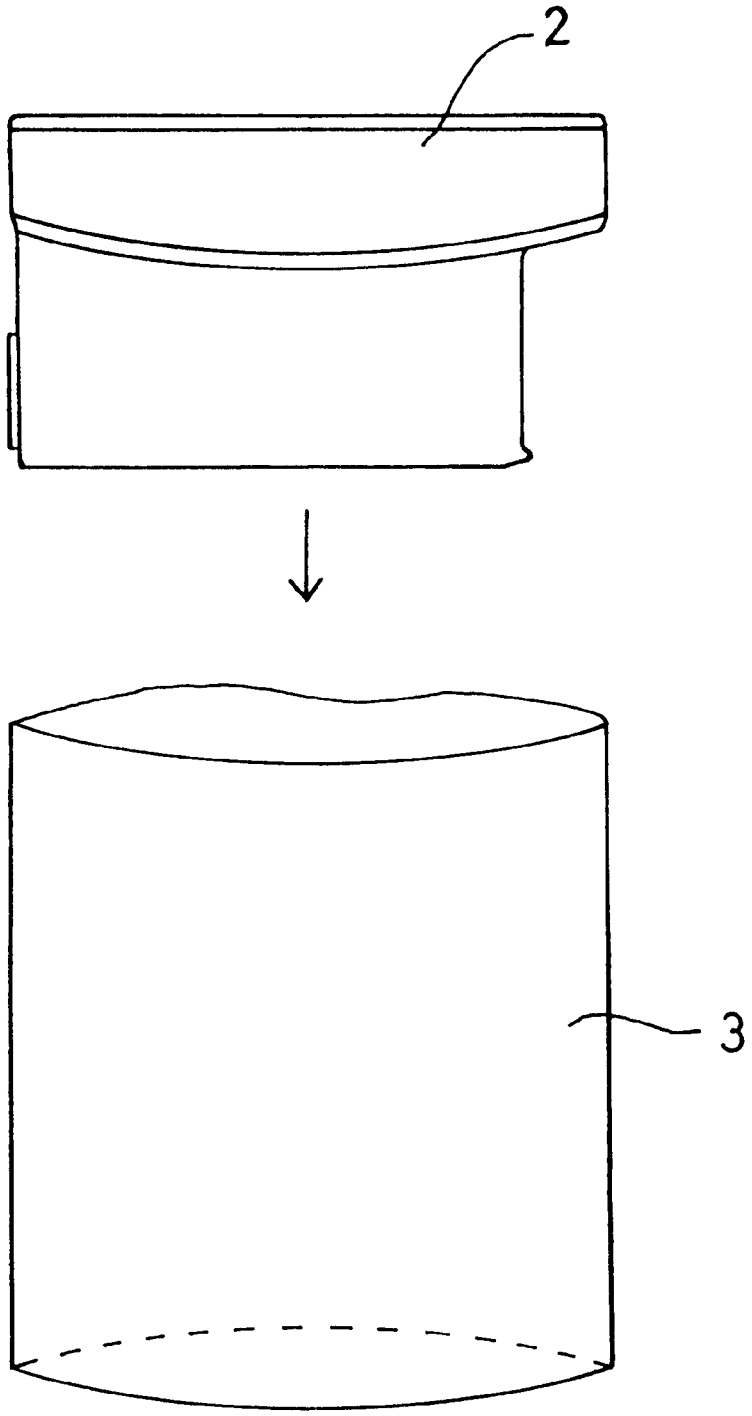
FIG. 4 is a view illustrating a direction of inserting the ink-cartridge into the packaging bag.

First, the ink cartridge 2, as shown in FIG. 4, in which degassed ink has been injected, is inserted into a sleeve-like packaging bag 3 in a substantially vacuum atmosphere (If 0 mmHg corresponds to atmospheric pressure and −760 mmHg corresponds to a vacuum pressure, a pressure of approximately −700 mmHg to −500 mmHg corresponds to the substantially vacuum atmosphere.). The inner surface of the packaging bag 3 is covered with a resin layer which is meltable and adherent to the ink cartridge 2 upon the application of heat.

The ink cartridge 2 has an ink supply hole 4B and an air hole 4C on opposite ends, and the packaging bag 3 has a width corresponding to the dimensions of the ink cartridge 2. Accordingly, when the ink cartridge 2 is inserted into the packaging bag 3, the inner surface of the packaging bag 3 comes into contact with the side surface of the ink cartridge 2 including the areas surrounding the ink supply hole 4B and the air hole 4C.

Then, a portion of the packaging bag 3 is stuck onto the areas around the ink supply hole 4B and the air hole 4C on the ink cartridge 2 by a heat sealing process in a peelable manner, whereby the ink supply hole 4B and the air hole 4C are sealed. This process is performed in the substantially vacuum atmosphere.

Figure 5:
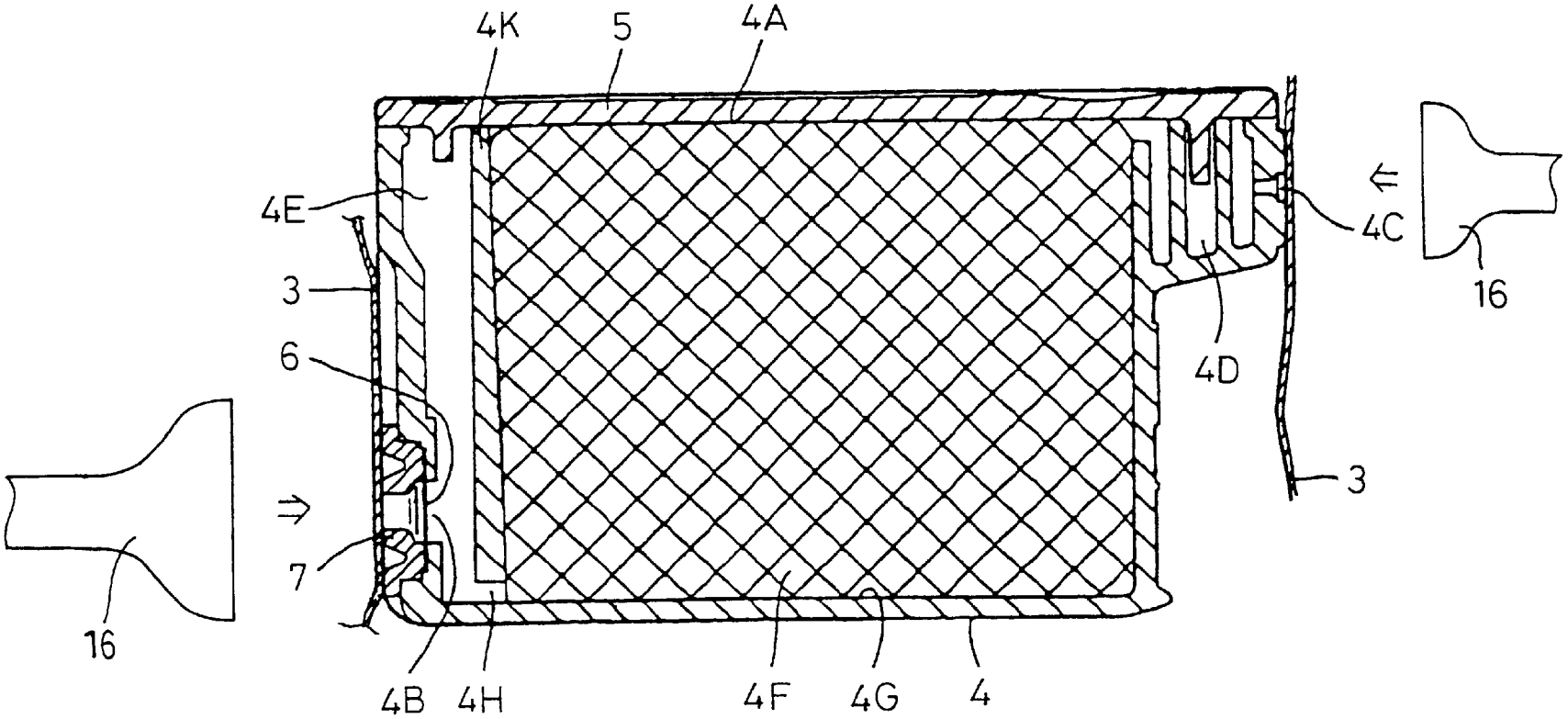
FIG. 5 is a view illustrating the heat sealing process.

In the heat sealing process, a heater 16 having an annular surface whose inner diameter is slightly larger than the diameter of each of the ink supply hole 4B and the air hole 4C is used. As shown in FIG. 5, the annular surface is pressed around the ink supply hole 4B and the air hole 4C, and these areas are heated for a predetermined time. Since the packaging bag 3 fits the ink cartridge 2 in such a manner that the inner surface of the bag 3 contacts with the side face of the ink cartridge 2, heat sealing is easily performed by simply pressing the annular surface of the heater 16, while holding the ink cartridge 2. It is not necessary to adjust the positional relationship between the ink cartridge 2 and the packaging bag 3.

Then, the top and bottom opening ends are flattened, and heat-sealed using another heater. These portions become top and bottom heat-sealed ends 3A and 3B. Finally, a notch 3C is formed in the heat-sealed end 3A, and the ink cartridge package 1 is completed.

As has been described, a portion of the packaging bag 3 for enclosing the ink cartridge 2 is used as a sealing member for sealing the ink supply hole 4B and the air hole 4C by sticking the packaging bag 3 onto the areas around the ink supply hole 4B and the air hole 4C through a heat sealing process. This method can obviate sealing tape used in a conventional package. When using a new ink cartridge, the user simply opens the packaging bag 3 and takes the ink cartridge out of the bag 3, whereby the ink supply hole 4B and the air hole 4C are automatically unsealed. The package of the invention is more convenient than a conventional package which requires two steps, opening the packaging bag and, then, peeling off the sealing tape.

Because the ink supply hole 4B and the air hole 4C are formed on the opposite ends of the ink cartridge 2, and because the packaging bag 3 has a width corresponding to the dimensions of the ink cartridge 2, the packaging bag 3 fits tightly to the side surfaces of the ink cartridge 2 including the areas surrounding the ink supply hole 4B and the air hole 4C upon insertion of the ink cartridge 2, and the heat sealing process can be easily performed. Even during shipping or transportation, the positional relationship between the ink cartridge 2 and the packaging bag 3 is kept stable, and no undesirable force is applied to the heat-sealed areas around the ink supply hole 4B and the air hole 4C. No concern will arise about unexpected peeling of the heat seal.

In addition, a notch 3C is formed in the top heat-sealed end 3A of the packaging bag 3 at a position closer to the air hole 4C than to the ink supply hole 4B. When taking the ink cartridge 2 out of the package 1, the packaging bag 3 is opened from the notch 3C, and the air hole 4C is exposed to the atmosphere first. This can prevent the air from mixing with the ink near the ink supply hole 4B. Because the notch 3C is formed in the heat-sealed end 3A which is hardened through the heat sealing process, it is easy for a user to tear the packaging bag 3 from the notch 3C.

After the edge portion of the packaging bag 3 is cut off, the ink supply hole 4B is still in the remaining portion of the packaging bag 3, and the heat seal around the ink supply hole 4B is unsealed within the remaining packaging bag 3. Even if a small quantity of ink scatters inside the remaining packaging bag 3 upon peeling, it is blocked by the inner wall of the packaging bag 3, and would not stain the surroundings.

Although, in the embodiment, a heat sealing process is used using a heater, sealing may also be performed using ultrasonic waves.

It should be understood that many changes and substitutions may be made by those skilled in the art without departing from the spirit and the scope of the invention.

What is claimed is:

1. An ink-cartridge package, comprising:

an ink cartridge containing ink, the ink cartridge defining an ink supply hole and an air hole; and a packaging bag that packages the ink cartridge, the packaging bag being a single piece including parallel layers including an outer layer for absorbing impact, a nonpermeable layer for preventing permeation of air and moisture and, an inner layer, the inner layer being meltable and adherent to the ink cartridge, such that a portion of the inner layer of the packaging bag is adhered to areas around the ink supply hole and the air hole on the ink cartridge in a peelable manner to seal the ink supply hole and the air hole.

2. The ink-cartridge package according to claim 1, wherein the inker cartridge is made of polypropylene and the inner layer is a resin made of polyolefin.

3. The ink-cartridge package according to claim 1, wherein the ink supply hole and the air hole are defined at opposite ends of the ink cartridge, and the packaging bag has a width corresponding to a width of the ink cartridge so that the packaging bag is fitted to the ink cartridge.

4. The ink-cartridge package according to claim 1, wherein the packaging bag is a sleeve-like bag having opening ends, the opening ends of the packaging bag being sealed.

5. The ink-cartridge package according to claim 1, wherein the packaging bag defines a notch for allowing the packaging bag to be opened easily, while leaving the ink supply hole still sealed with a part of the packaging bag which wraps around a side surface of the ink cartridge extending from the ink supply hole.

6. The ink-cartridge package according to claim 1, wherein the packaging bag defines a notch for opening the packaging bag from a position closer to the air hole than to the ink supply hole.

7. The ink-cartridge package according to claim 5, wherein the notch is formed at a position closer to the air hole than to the ink supply hole.

8. The ink-cartridge package according to claim 6, wherein the notch is formed at a position closer to the air hole than to the ink supply hole.

9. The ink-cartridge package according to claim 1, wherein the inner layer is a resin made of at least one of polypropylene, polyethylene and polyolefin.

10. The ink-cartridge package according to claim 1, wherein the outer layer is made of at least one of nylon and PET.

11. A packaging bag for use with an ink cartridge containing ink, the ink cartridge defining an ink supply hole and an air hole, the packaging bag being a single piece including parallel layers comprising:

an outer layer for absorbing impact;

a non permeable layer for preventing permeation of air and moisture; and an inner layer that is meltable and adherent to the ink cartridge, such that a portion of the inner layer adheres to areas around the ink supply hole and the air hole on the ink cartridge in a peelable manner to seal ink supply hole and the air hole.

12. The packaging bag according to claim 11, wherein the outer layer is made of at least one of nylon and PET.

13. The packaging bag according to claim 11, wherein the inner layer is a resin made of at least one of polypropylene, polyethylene and polyolefin.

14. The packaging bag according to claim 11, wherein the inner layer is meltable upon being heated.

* * * * *